US005531326A

United States Patent [19]

Hummel et al.

[11] Patent Number: 5,531,326

[45] Date of Patent: Jul. 2, 1996

[54] REINFORCEMENT AND CONTAINER USING SAME

[75] Inventors: Steven L. Hummel, Ortonville; James P. Olender, Fenton; James B. Johnson, Plymouth; JoAnn Reynolds, Fenton; Bill A. Skaggs, Flint, all of Mich.

[73] Assignee: Creative Foam Corporation, Fenton, Mich.

[21] Appl. No.: 367,816

[22] Filed: Jan. 3, 1995

[51] Int. Cl.[6] ..... B65D 21/032

[52] U.S. Cl. ..... 206/509; 206/512; 220/642; 220/640

[58] Field of Search ..... 220/642, 640, 220/646, 6, 7; 206/512, 509, 511, 821; 229/198, 198.1, 199, 918

[56] References Cited

U.S. PATENT DOCUMENTS

| | | | |
|---|---|---|---|
| 329,875 | 11/1885 | Andrews . | |
| 1,162,798 | 12/1915 | Morton | 229/198.1 |
| 1,383,499 | 7/1921 | Tisch . | |
| 1,656,161 | 1/1928 | Berndt . | |
| 1,684,898 | 9/1928 | Trautman . | |
| 2,009,527 | 7/1935 | Shelton . | |
| 2,138,424 | 11/1938 | McCutchen . | |
| 2,169,450 | 8/1939 | McCutchen . | |
| 2,191,291 | 2/1940 | Smith | 229/198 X |
| 2,339,445 | 1/1944 | Wynne et al. . | |
| 2,421,238 | 5/1947 | Borah | 229/198 X |
| 2,462,693 | 2/1949 | Wabshaw | 206/511 X |
| 2,496,965 | 2/1950 | Swingle . | |
| 2,634,021 | 4/1953 | Cella . | |
| 2,652,174 | 9/1953 | Shea et al. . | |
| 3,220,633 | 3/1964 | Swane . | |
| 3,226,008 | 12/1965 | Chiorri . | |
| 3,246,826 | 4/1966 | Clemens . | |
| 3,315,835 | 4/1967 | Katzman . | |
| 3,368,736 | 2/1968 | McKellick . | |
| 3,406,893 | 10/1968 | Swane . | |
| 3,544,021 | 12/1970 | Wilson et al. | 206/511 X |
| 3,659,774 | 5/1972 | Mielke | 220/642 |
| 4,126,265 | 11/1978 | Holmes . | |
| 4,779,751 | 10/1988 | Munroe . | |
| 4,787,553 | 11/1988 | Hoskins . | |
| 4,799,620 | 1/1989 | Vilella . | |
| 4,971,201 | 11/1990 | Sathre | 220/642 |
| 5,037,027 | 8/1991 | Nichols . | |
| 5,429,261 | 7/1995 | Machino | 220/7 |

FOREIGN PATENT DOCUMENTS

| | | | |
|---|---|---|---|
| 2188036 | 9/1987 | United Kingdom . | |
| 0004304 | 7/1995 | United Kingdom | 229/198 |

*Primary Examiner*—Stephen J. Castellano
*Attorney, Agent, or Firm*—Brooks & Kushman

[57] ABSTRACT

A container reinforcement that comprises a pair of interlockable members, at least one of which is movable with respect to the other. The interlockable members have cooperable lock portions that interfit with one another and can be used to manually, removably attach the reinforcement to a container. A container using such a reinforcement.

20 Claims, 3 Drawing Sheets

Fig. 1
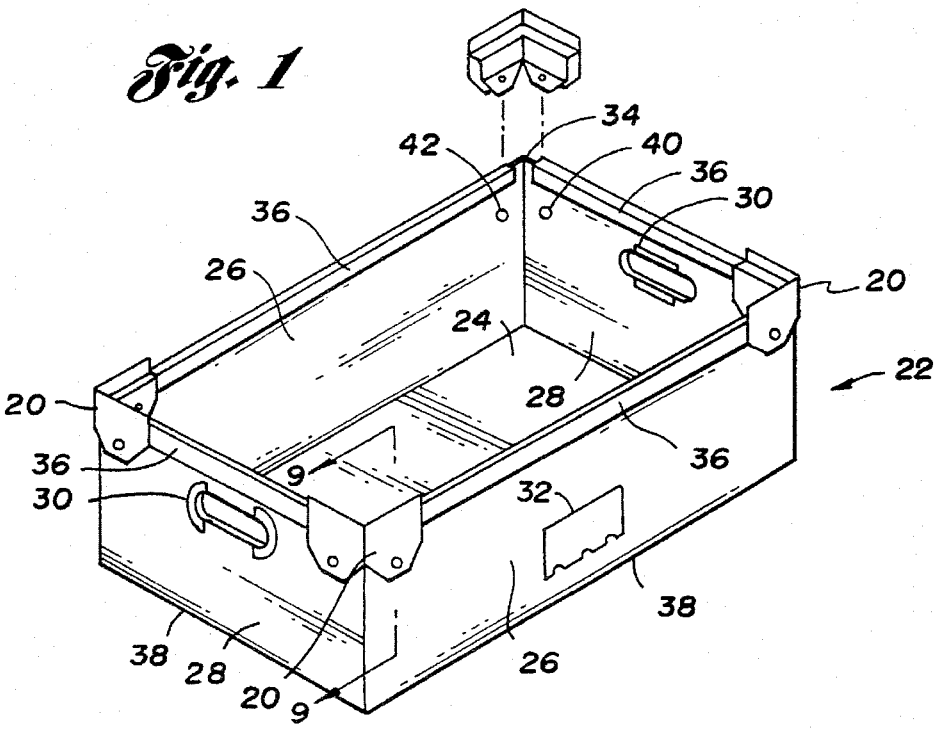
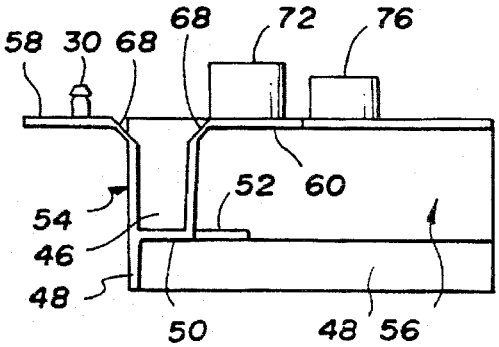
Fig. 4
Fig. 3
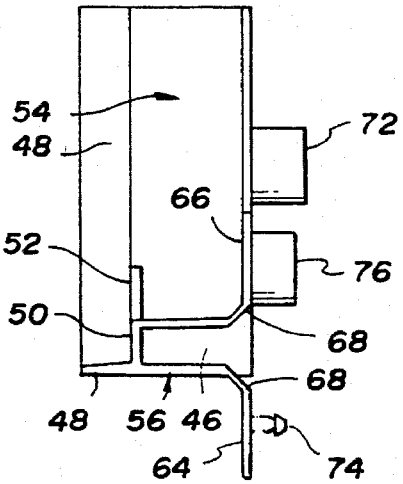
Fig. 2
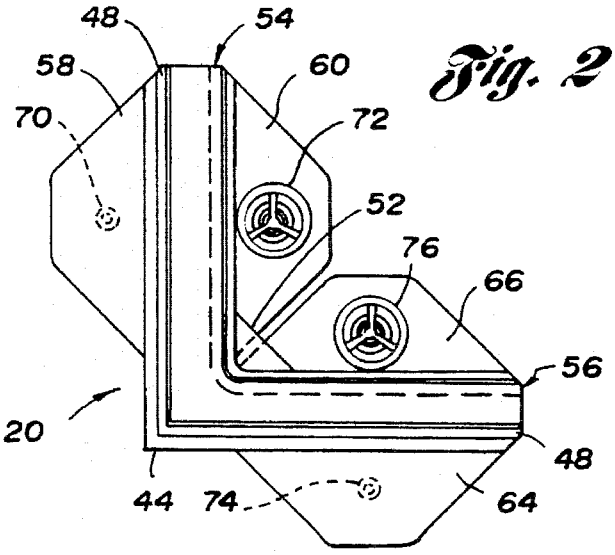

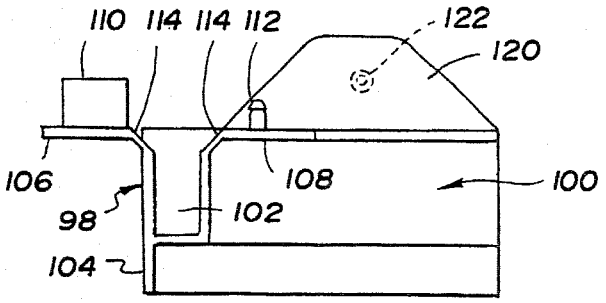
Fig. 11
Fig. 12
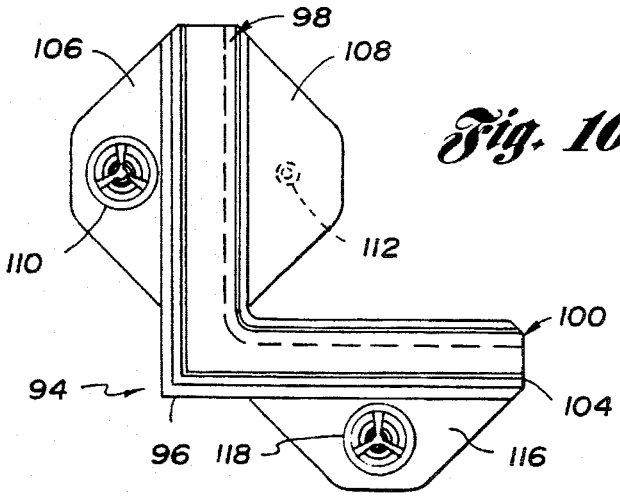
Fig. 10
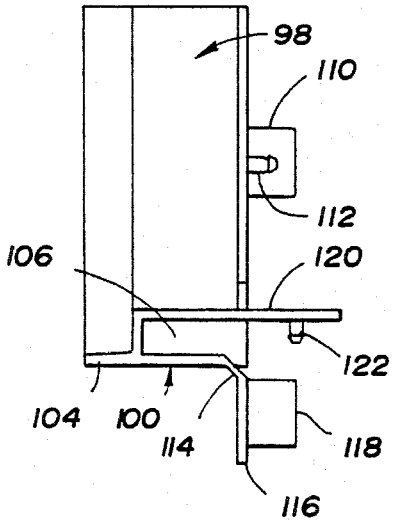
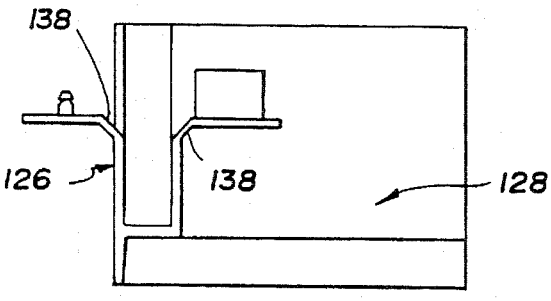
Fig. 14
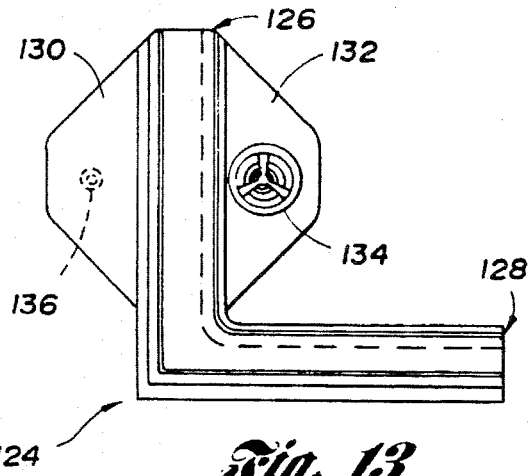
Fig. 13
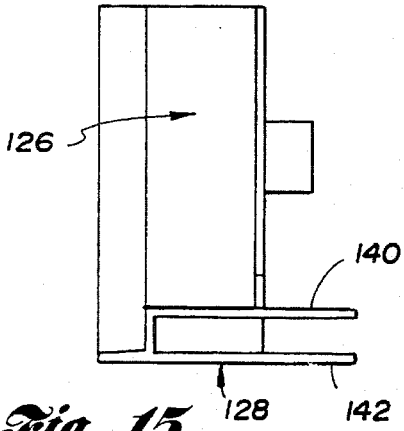
Fig. 15

REINFORCEMENT AND CONTAINER USING SAME

TECHNICAL FIELD

The invention relates to reinforcements for containers and containers using such reinforcements.

BACKGROUND ART

Containers are often used in industry or other areas for storing and/or transporting goods. These goods may include replacement parts, or component parts in a manufacturing process.

Because these containers may be used to carry and store heavy articles, it is desirable that they be sturdy. Additionally, because the containers may be used in an environment where space is limited, it is desirable that these containers be stackable.

The prior art includes containers that address these concerns of sturdiness and stackability. For example, Nichols U.S. Pat. No. 5,037,027 discloses a container having reinforcement members (referred to in the Nichols patent as "corner enhancer structural angles") integrated with the side edges of the container to enhance stability of the container. The Nichols patent also discloses structural corners (referred to as "stacking lug structural corners") that attach to the upper edges of the container. The structural corners include a raised lip to provide for stacking several containers. The structural corners are attached, however, by rivets. This renders assembly and disassembly of the container more difficult, Other prior art container corners can be used with only particular types of containers. For example, Hoskins U.S. Pat. No. 4,787,553 discloses a container corner useful for only a corrugated cardboard container or similar structure.

DISCLOSURE OF INVENTION

Accordingly, it is an object of the present invention to provide a container reinforcement member that can be easily and manually attached and removed.

It is a further object of the present invention to provide a reinforcement that lends structural stability to the container, and provides for stacking of several container.

It is yet another object of the present invention to provide a container reinforcement that can be removably attached to a container without the need for additional fasteners.

The reinforcement of the present invention is for use on the edge portion of a container. The reinforcement comprises a body for receiving the edge portion, and at least one pair of interlockable members, or wings. At least one of the interlockable members is movable with respect to the other interlockable member. The interlockable members have cooperable lock portions adapted to removably interfit with each other when the movable interlockable member moves with respect to the other interlockable member.

When the container reinforcement is placed on the container, the moveable interlockable member or members are bent downwardly to enable the male and female lock portions to removably engage with one another. Preferably, engagement and disengagement cain be performed manually.

The reinforcement may contain a second pair of interlockable members, or wings, extending from the second arm of the body. The second pair c,f interlockable members have cooperable lock portions that removably engage one another when the reinforcement is fitted to the container.

BRIEF DESCRIPTION OF DRAWING

FIG. 1 shows a perspective view of a container incorporating the reinforcement of the present invention;

FIG. 2 shows a top view of a reinforcement embodying the present invention;

FIGS. 3 and 4 show side views of the reinforcement of the present invention;

FIG. 10 shows a top view of an alternative embodiment of the present invention;

FIGS. 11–12 show side views of the alternative embodiment of the present invention;

FIG. 13 shows a top view of another alternative embodiment of the present invention; and FIGS. 14–15 show side views of the alternative embodiment of the present invention.

BEST MODES FOR CARRYING OUT THE INVENTION

Figure 5:
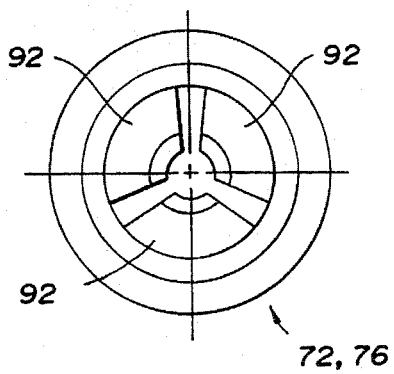
FIG. 5 shows an enlarged top view of the female lock portion of the present invention.
Figure 6:
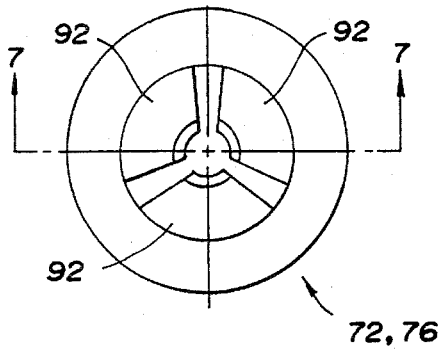
FIG. 6 shows an enlarged bottom view of the female lock portion of the present invention.
Figure 7:
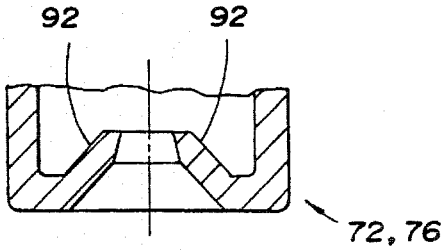
FIG. 7 shows a cross-sectional view of the female lock portion of the present invention.
Figure 8:
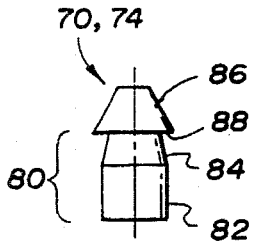
FIG. 8 shows an enlarged view of the male lock portion of the present invention.
Figure 8A:
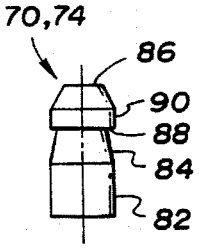
FIG. 8A shows an enlarged view of an alternative version of the male lock portion of the present invention.

Referring to FIG. 1, the preferred embodiment of the reinforcement 20 of the present invention is for use with container 22 having a bottom 24, side walls 26, and end walls 28. The container may also have handles 30 and a label 32. The side walls 26 and end walls 28 may be double walled.

In the preferred embodiment each of the side walls 26 and end walls 28 has an upper edge 34, which may be covered by an edge reinforcer 36, and a lower edge 38. The container 22 shown also has prefabricated end wall apertures 40 and side wall apertures 42 for use with the present invention. It is appreciated that the present invention may be used for a variety of containers, including cylindrical containers, and other containers having greater or fewer than four walls. The 10 container shown in FIG. 1 is merely illustrative. Also, the reinforcement 20 may also be used to connect two containers to one another, side by side, if, for example, it is manufactured linearly, rather than in an L-shape.

Referring to FIGS. 2–4, the reinforcement comprises a body 44 that is formed to provide a channel 46 engagable with the container 22. In particular, in the preferred embodiment, the channel 46 is dimensioned so that the reinforcement 20 fits snugly over the upper edge 34 or edge reinforcer 36 of the container. The reinforcement 20 also includes a lip 48 that extends upwardly from the body. When several reinforcements 20 are attached to the container 22, the reinforcement lips 48 facilitate stacking of several containers. When stacked, the lower edges 38 of one container 22 rest on the resting surfaces 50 of the several reinforcements 20. The surface area of the resting surfaces 50 may be enlarged if a gusset 52 is added to the reinforcement 20. The lip 48 of the reinforcement 20 prevents the containers from sliding with respect to one another.

The reinforcement body 44 has a first arm 54 and a second arm 56. A first wing 58 extends outwardly from the first arm 54. A second wing 60 extends inwardly from the first arm 54. In the preferred embodiment, a third wing 64 extends outwardly from the second arm 56 and a fourth wing 66 extends inwardly from the second arm 56. As is described below, the first and second wings 58 and 60 are interlockable, and the third and fourth wings 64 and 66 are interlockable.

Each of the four wings is attached to the arms 54 and 56 of body 44 by a living hinge 68 in the preferred embodiment. The reinforcing corner is made of molded plastic, and the living hinge 68 is formed by designing the mold so that the hinge is thinner than the remainder of the body 44. It should be appreciated that the reinforcement of the present invention could be made of many materials, including polyethylene, polyvinylchloride, polypropylene, rubber, structural foam or other suitable materials. Injection moldable materials are preferred. If made out of the same material as the container, recycling is facilitated. Also, it should be appreciated that the wings could be manufactured separately and attached by other structures or in other ways without affecting the scope of the present invention.

In the preferred embodiment, the first wing 58 has a male lock portion, or locking pin 70. The second wing 60 has a female lock portion, or socket 72. The male lock portion 70 and the female lock portion 72 are removably engagable with one another. In particular, when the first and second wings 58 and 60 are bent downwardly, the first male and female lock portions 70 and 72 enter an end wall aperture 40 and can be manually engaged, rendering the first and second wings 58 and 60 interlockable. The first male and female lock portions can also be manually disengaged if force greater than that the force applied for engagement is applied in the opposite direction. The force required for disengagement is high enough to prevent disengagement during use, but low enough to allow for disengagement without destroying the lock portions 70 and 72. This renders the reinforcement reusable.

In the preferred embodiment, the third wing 64 has a second male lock portion 74, and the fourth wing 66 has a second female lock portion 76. As described above for the first male and female lock portions 70 and 72, the second male and female lock portions 74 and 76 are manually and removably engageable with one another, and can be engaged when the third and fourth wings 64 and 66 are bent downwardly toward one another.

Referring to FIGS. 5–8*a*, each of the male lock portions, or locking pins 70 and 74, have a shank 80 having a cylindrical portion 82 and a tapered portion 84. The locking pin terminates in a frusto-conical tang 86. The junction of the tapered portion 84 of the shank 80 and the tang 86 provides an undercut surface 88. The tang 86 may include a cylindrical portion 90 to reduce deformation during, and hence to facilitate, engagement and disengagement. Each of the female lock portions, or sockets 72 and 76, comprises a plurality of inwardly directed flanges 92. The reinforcement 20 may be more easily manufactured with a single, circumferential flange 90.

Figure 9:
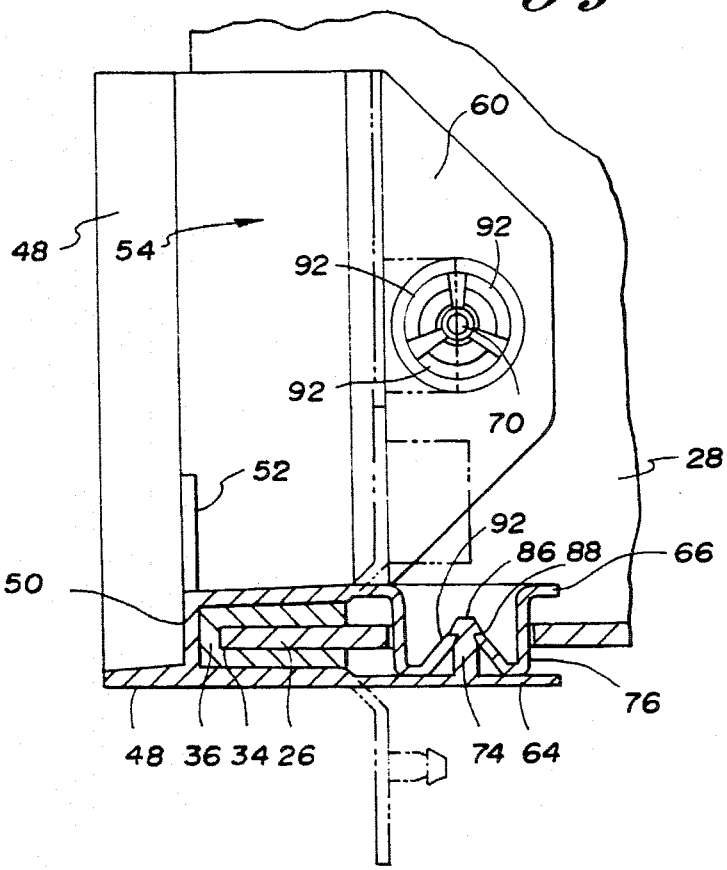
FIG. 9 shows an enlarged sectional view of the reinforcement of the present invention attached to a container.

Referring to FIG. 9, when the third and fourth wings 64 and 66 are bent downwardly, the locking pin 74, and the socket 76 pass through side wall aperture 42 and engage with one another. When the locking pin 74 is inserted in socket 76, the frustoconical tang 86 temporarily deforms the flanges 92 so that the undercut surface 88 of the locking pin 74 snaps over the flanges 92 of the socket 76 to firmly lock the locking pin in the socket. The locking pin and socket can thus be manually engaged with one another. The locking pin and socket can also be manually disengaged from one another, as described above.

Referring to FIGS. 10–12, an alternative embodiment of the reinforcement 94 of the present invention is shown. The alternative reinforcement 94 comprises a body 96, and first 98 and second 100 arms. The body is molded to form a channel 102 fitted for engagement with the upper edge 34 or edge reinforcer 36 of the container 22. The alternative reinforcing corner 94 also comprises a lip 104 that facilitates stacking of several containers 22.

A first wing 106 and a second wing 108 extend outwardly and inwardly, respectively, from the first arm 98. The first wing 106 has a female locking portion, or socket, 110. The second wing 108 has a male locking portion, or locking pin 112. The first and second wings 106 and 108 extending from first arm 98 are attached to the arm via living hinges 114. Comparing FIGS. 2 and 10, it can be seen that the male and female locking portions can be placed on either the inner or outer wings without affecting the present invention.

Referring again to FIGS. 10–12, the alternative embodiment also includes a third wing 116 extending outwardly from the second arm 100, and having a female lock portion 118. Like the first and second wings 106 and 108, this third wing 116 is attached to the body 96 via a living hinge 114.

A fourth wing 120 extends downwardly from the second arm 100. Unlike the other wings, this fourth wing 120 is not hinged. The fourth wing permanently extends downwardly away from the body. The fourth wing 128 has a male lock portion 122 that is engaged with female lock portion 118 of the third wing 116 when the third wing 116 is bent down via hinge 114. It should be appreciated that another alternative embodiment for the present invention could include two arms having a configuration shown for arm 100. Both arms of the reinforcing corner could include one fixed, downwardly extending, wing, and one hinged wing extending either outwardly or inwardly from the arm.

Referring to FIGS. 13–15, another alternative embodiment of a reinforcement 124 of the present invention is shown having a first arm 126 and a second arm 128. A first wing 130 extends outwardly, and a second wing 132 extends inwardly, from the first arm 126. The second wing 132 has a female lock portion, or socket, 134, and the first wing 130 has a male lock portion, or locking pin, 136. The first and second. wings 130 and 132 are attached to the first arm 130 by hinges 138. The male and female lock portions 134 and. 136 are manually removably engageable with one another.

Second arm 128 has a third wing 140 and a fourth wing 142, both extending downwardly therefrom. These wings do not have male and female lock portions. They are provided, however, for support to the container. This alternative embodiment illustrates that the present invention does not require two male and female lock portions.

It is to be understood that the present invention has been described in an illustrative manner and the terminology which has been used is intended to be in the nature of words of description rather than of limitation. Obviously, many modifications and variations of the present invention are possible in light of the above teachings. Therefore, it is also to be understood that, within the scope of the following claims, the invention may be practiced otherwise than as specifically described.

What is claimed is:

1. A reinforcement for an edge portion of a container, said reinforcement comprising:

a body for receiving said edge portion;

a pair of interlockable members integrally molded with and extending from said body, at least one of said interlockable members movable with respect to the other of said interlockable members; and said interlockable members having cooperable lock portions adapted to removably interfit with each other when said at least one movable interlockable member moves with respect to the other of said interlockable members.

2. The reinforcement of claim 1 wherein said movable interlockable member is hinged to said body.

3. The reinforcement of claim 1 wherein said movable interlockable member is integral with said body.

4. The reinforcement of claim 1 further comprising a lip extending from said body whereby containers incorporating said reinforcement may be stacked upon one another.

5. The reinforcement of claim 1 wherein one of said pair of interlockable members does not move with respect to said body.

6. The reinforcement of claim 2 wherein said hinge is a living hinge.

7. The reinforcement of claim 1 wherein the reinforcement is adapted for use with a container having four walls.

8. The reinforcement of claim 1 wherein said lock portions can be removably interfit manually.

9. The reinforcement of claim 1 further comprising a second pair of interlockable members, at least one of which is movable with respect to said body, said second pair of interlockable members having cooperable lock portions adapted to removably interfit with each other.

10. A reinforcing corner for a container having one or more walls, the reinforcing corner comprising:

a body portion engageable with one or more of the container walls;

a first wing member integrally molded with and extending from said body portion and having a lock portion;

said first wing member movable with respect to said body portion;

a second wing member integrally molded with and extending from said body portion and having a lock portion cooperable with said the lock portion of said first wing member; and said lock portions adapted to removably interfit with each other when said first wing member moves with respect to the other of said interlockable members.

11. The reinforcement of claim 10 wherein said first wing member is hinged to said body.

12. The reinforcement of claim 10 wherein first wing member is integral with said body.

13. The reinforcement of claim 10 further comprising a lip extending from said body whereby containers incorporating said reinforcement may be stacked upon one another.

14. The reinforcement of claim 10 wherein said second wing member does not move with respect to said body.

15. The reinforcement of claim 11 wherein said hinge is a living hinge.

16. The reinforcement of claim 10 wherein the reinforcement is adapted for use with a container having four walls.

17. The reinforcement claim 10 wherein said lock portions can be removably interfit manually.

18. The reinforcing corner of claim 10 further comprising:

a third wing member extending from said body portion and having a lock portion;

said third wing member movable with respect to said body portion;

a fourth wing member extending from said body portion and having a lock portion cooperable with said the lock portion of said third wing member; and the lock portions of said third and fourth wing members adapted to removably interfit with each other when said third wing member moves with respect to said fourth wing member.

19. A reinforcing corner for a tote container having a bottom, four walls, and four upper corners, each corner defined by the intersection of the upper edges of adjacent walls, the reinforcing corner comprising:

a body portion engageable with any one of the tote corners and the upper edges of the two adjacent walls;

a first wing member hinged to said body portion and having an integral male snap member;

a second wing member hinged to said body portion and having an integral female snap member removably adapted to removably interfit with the male snap member of said first wing member when said first and second wing members are moved with respect to one another;

a third wing member hinged to said body portion and having an integral male snap member; and a fourth wing member hinged to said body portion and having an integral female snap member adapted to removably interfit with the male snap member of said third wing member when said third and fourth wing members are moved with respect to one another.

20. A container comprising:

an edge portion;

a reinforcement for said edge portion;

said reinforcement having a body portion and a pair of interlockable members integrally molded with and extending from said body portion, at least one of said interlockable members movable with respect to the other of said interlockable members; and said interlockable members having cooperable lock portions adapted to removably interfit with each other when said at least one movable interlocable member moves with respect to the other of said interlockable members.

* * * * *

UNITED STATES PATENT AND TRADEMARK OFFICE

CERTIFICATE OF CORRECTION

PATENT NO. : 5,531,326
DATED : July 2, 1996
INVENTOR(S) : Steven L. Hummel, James P. Olender, James B. Johnson, JoAnn Reynolds, Bill A. Skaggs It is certified that error appears in the above-indentified patent and that said Letters Patent is hereby corrected as shown below:

Column 1, line 32: "," should be --.--.

Column 1, line 45: "container" should be --containers--.

Column 1, line 63: "cain" should be --can--.

Column 1, line 67: "c,f" should be --of--.

Column 2, line 52: before "container" delete the reference numeral "10".

Column 6, line 7, claim 17: after "reinforcement" insert --of--.

Column 6, line 54, claim 20: "interlocable" should be --interlockable--.

Signed and Sealed this

Twenty-first Day of January, 1997

*Attest:*

Bruce Lehman

BRUCE LEHMAN

*Attesting Officer*

*Commissioner of Patents and Trademarks*